United States Patent [19]

Theurer

[11] 3,981,247

[45] Sept. 21, 1976

[54] TRACK WORKING MACHINE WITH VIBRATORY AND RECIPROCABLE TRACK WORKING TOOLS

[75] Inventor: Josef Theurer, Vienna, Austria

[73] Assignee: Franz Plasser Bahnbaumaschinen-Industriegesellschaft m.b.H., Vienna, Austria

[22] Filed: Mar. 24, 1975

[21] Appl. No.: 561,115

[30] Foreign Application Priority Data

May 9, 1974 Austria ..... 3855/74

[52] U.S. Cl. ..... 104/12

[51] Int. Cl.[2] ..... E01B 27/16

[58] Field of Search ..... 104/12, 7 R, 10; 404/133; 173/116; 60/384, 421, 429, 537; 91/36, 39

[56] References Cited

UNITED STATES PATENTS

| | | | |
|---|---|---|---|
| 3,669,025 | 6/1972 | Plasser et al. | 104/12 |
| 3,810,417 | 5/1974 | Sieke | 91/39 |
| 3,885,883 | 5/1975 | Sieke et al. | 104/10 X |

FOREIGN PATENTS OR APPLICATIONS

| | | | |
|---|---|---|---|
| 956,486 | 4/1964 | United Kingdom | 91/39 |

*Primary Examiner*—L. J. Paperner
*Assistant Examiner*—Randolph A. Reese
*Attorney, Agent, or Firm*—Kurt Kelman

[57] ABSTRACT

Hydraulically reciprocable and vibratory track working tools are operated with a control in the hydraulic circuit which generates a pulsating stream of hydraulic fluid and delivers this stream to a separate hydraulic motor to which hydraulic reciprocating motors are connected or directly to the hydraulic reciprocating motors for the tools so as to vibrate the same. The control includes an impulse generator for imparting impulses to the hydraulic fluid and a check valve assembly, control conduits for delivering the pulsating hydraulic fluid stream to inlets of the valve assembly, further conduits for delivering the pulsating hydraulic fluid stream from the outlets of the valve assembly to respective chambers defined by the hydraulic motors, and respective ones of the valves alternatingly blocking and permitting passage of the pulsating hydraulic fluid stream from the inlets to the outlets of the valve assembly.

10 Claims, 2 Drawing Figures

TRACK WORKING MACHINE WITH VIBRATORY AND RECIPROCABLE TRACK WORKING TOOLS

Figure 1:
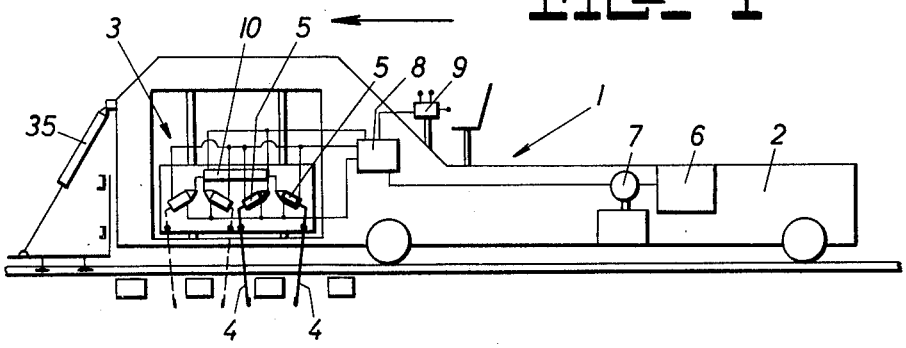

The present invention relates to a track working machine comprising reciprocable and vibratory tools for working the track, and more particularly to a mobile track tamper comprising a frame mounted for mobility of the track and having reciprocable and vibratory tamping tools mounted thereon for tamping ballast. In such a machine, it has been proposed to provide hydraulic motor means for reciprocating and vibrating the tools, the hydraulic motor means including a hydraulic motor associated with each tool for reciprocating the same, and a hydraulic circuit including a hydraulic fluid sump, a pump for delivering hydraulic fluid from the sump to the hydraulic motor means and return conduit means for returning hydraulic fluid to the sump.

Different operating conditions due to different track conditions often make track maintenance work with such machines difficult. These differences may be caused, for example, by different ballast, such as ballast of different particle sizes, degree of compaction of encrustation, as well as differences in required track corrections. For instance, it may be advantageous vigorously to vibrate the ballast during tamping when the ballast is heavily encrusted. Also, differences in the lifting stroke during track leveling cause different amount of ballast to be tamped under the ties of the leveled track, and only a change in the tamping force will provide a uniformly good support for the leveled track under such conditions. These operating conditions may change during maintenance work from tie to tie but also from track section to track section to be surfaced in a continuous operation along a stretch of track.

Good track maintenance results have been obtained with track tampers using hydraulically operated tamping tool units. In such machines, it has been proposed to actuate not only the reciprocation and vibration but also the vertical adjustment of the tamping tools hydraulically. U.S. Pat. No. 3,735,708, dated May 29, 1973, for example, proposes a particularly space-saving and structurally simple hydraulic vibration drive for tamping tools, using a motor with linearly reciprocating piston means and means for continuously supplying a unidirectionally flowing hydraulic fluid to the piston means.

Published German patent application No. 2,120,045, discloses an apparatus for vibrating a hydraulically operated working tool. This apparatus, which may be used in track work, provides a sole slide valve supposedly designed to transmit high-frequency vibrations to a hydraulically operated working tool. The apparatus disclosed in this publication has found no practical use, apparently because high friction resistance is caused by the constant reversal of the hydraulic fluid stream by the axially reciprocating piston in the valve, the hydraulic fluid inhibiting and delaying the reciprocation between the piston and the cylinder of the valve so that high frequencies cannot be attained.

It is the primary object of this invention to provide a track working machine of the described type with a universally adaptable control for the vibration of the track working tools under differing operating and track conditions.

The above and other objects are accomplished in accordance with the invention with a control in the hydraulic circuit for generating a pulsating stream of the hydraulic fluid and delivering the pulsating stream to the hydraulic motor means whereby the tools are vibrated. The control includes an impulse generator for imparting impulses to the hydraulic fluid and thereby generating the pulsating hydraulic fluid stream, and a valve assembly including a plurality of check valves and having inlet means and outlet means. Control conduit means deliver the pulsating hydraulic fluid stream to the inlet means of the valve assembly, further conduit means deliver the pulsating hydraulic fluid stream from the outlet means of the valve assembly to respective chambers defined by the hydraulic motor means for reciprocating and vibrating the tools, and respective ones of the valves alternately block and permit passage of the pulsating hydraulic fluid stream from the inlet to the outlet means of the valve assembly.

The combination of these features makes it possible, for instance, not only to change the frequency of the tool vibratiion but also to adjust this frequency, as well as the amplitude of vibration, during operation. In this manner, the vibration control is dependably and rapidly responsive to almost all operating and track conditions for optimal track work efficiency. Thus, it is possible to adjust a single movement of the track working tool to a locally changed track condition and to change the magnitude of the reciprocating force continuously during operation in accordance with changing requirements. Very high vibration frequencies may be obtained since the friction losses in the hydraulic medium are minimal. The hydraulic fluid flow is controlled in pulses and remains unidirectional, i.e. it is never reversed, which fundamentally increases the responsiveness of the system, the use of a valve assembly being very advantageous because of its responsiveness. The control also obviates or at least considerably reduces harmonic vibrations.

In accordance with a preferred embodiment of the present invention, the impulse generator is a hydraulic pump, preferably a rotary piston pump whose opposed pistons are connected with their respective pressure outlets to control conduits leading to the valve assembly. This obviates the need of an additional pump for producing the vibrations of the tools since the same pump may be used to deliver hydraulic fluid not only for the reciprocation of the tools but also for their vibration, and even for the vertical adjustment of the tool carrier.

The hydraulic motors means may consist of a hydraulic motor associated with each tool for reciprocating the same, in which case the control is connected to the chambers of thee hydraulic motors for reciprocating and vibrating the tools. This enables the operator of a track tamper to control the vibration of a reciprocating tamping tool readily where the tool encounters a particularly encrusted ballast portion. However, the hydraulic motor means may also include a further hydraulic motor to which the control is connected, in which case the hydraulic motor associated with each tool is connected to the further hydraulic motor for vibration of the hydraulic motor and the tool associated therewith while the hydraulic motor is used solely for reciprocation of the tool. This makes it possible, in case the control is used for a double-tie tamping unit, to change the tool reciprocating pressure of one of the pairs of tools of the unit while operating all the tools at the same vibration frequency and amplitude.

Figure 2:
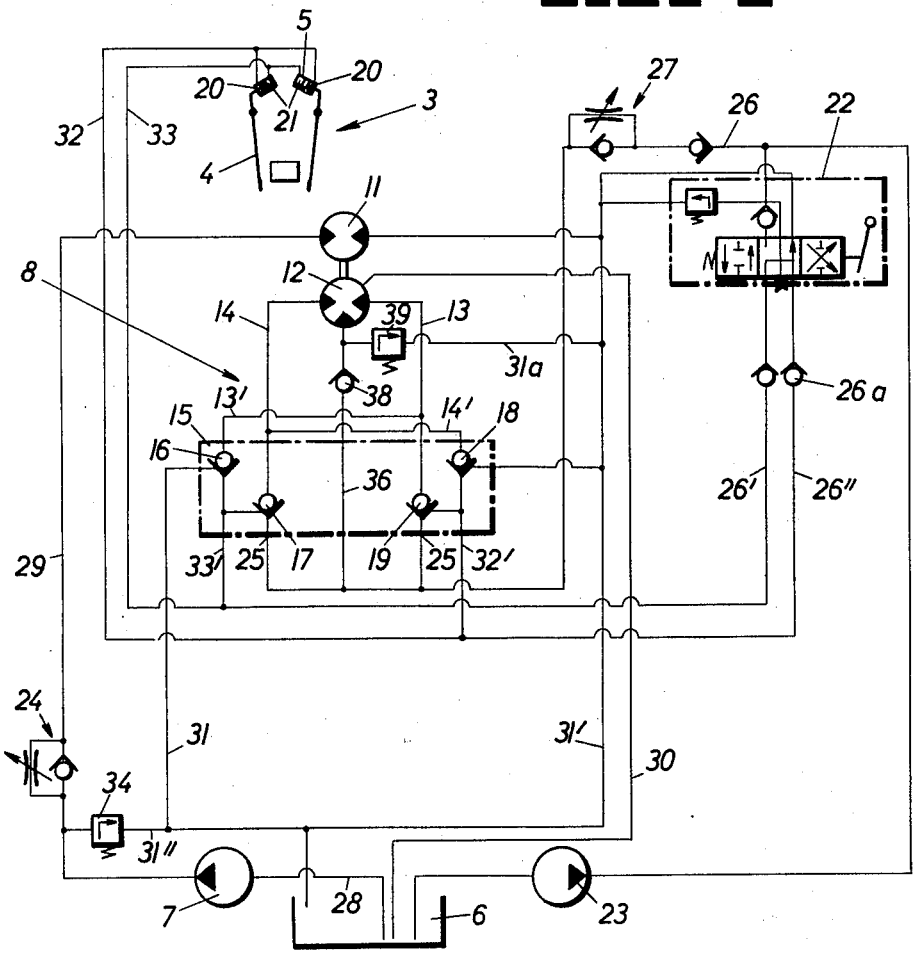

The above and other objeccts, advantages and features of the present invention will become more apparent from the following detailed description of a now preferred embodiment thereof, taken in conjunction with the accompanying drawing wherein FIG. 1 is a schematic side elevational view of a mobile track tamper incorporating a control for the vibration and reciprocation of the tamping tools in accordance with this invention; and FIG. 2 is a simplified circuit diagram showing the structure and operation of the control.

Referring now to the drawing and first to FIG. 1, there is shown a track working apparatus constituted by mobile track tamper 1 whose frame 2 has undercarriages moving on the track rails in an operating direction indicated by a horizontal arrow. An overhanging front portion of the machine frame extends beyond the front undercarriage of tamper 1 and has mounted thereon tamping unit 3 comprising a vertically movable tamping tool carrier supporting a pair of tamping tools 4 (or two adjacent pairs of tamping tools, as indicated in broken lines in FIG. 1). The tamping tools of each pair are reciprocable in the direction of track elongation for tamping ballast under each tie of the track when the tamping tool carrier is lowered to immerse the tamping tool jaws in the ballast. Reciprocation of the tamping tools is effected by hydraulic motors 5 each consisting of a cylinder part and a piston rod part, one of the motor parts being linked to the tamping tool carrier while the other motor part is linked to an upper end of the tamping tool. Two such transversely aligned pairs of tamping tools are associated with each track rail on either side of the rail so as to tamp the ballast properly under each point of intersection between tie and rail. As shown, track lifting means 35 is mounted at the front of the machine frame for correcting the track position in respect of a reference system (not shown).

The track tamper of FIG. 1 is a conventional track working apparatus illustrated merely by way of example, such machines being more fully descirbed and illustrated, for instance, in U.S. Pat. Nos. 3,372,651, dated Mar. 12, 1968, 3,381,625, dated May 7, 1968, and 3,545,384, dated Dec. 8, 1970. These patents are merely illustrative, a great many similar or different track working machines, track tampers, track liners, and track leveling machines, being widely known. The specific type of track working apparatus forms no part of the invention.

Since the tamping tool reciprocation and vibration is hydraulically operated in the illustrated embodiment, storage tank 6 for hydraulic fluid is mounted on machine frame 2, the hydraulic circuit for operating tamping tools 4 including constant speed pump 7 whose input is connected to hydraulic fluid sump 6 by means of suction conduit 28 and whose output is connected to control 8 of the present invention by means of delivery conduit 29. The control converts the flow of hydraulic fluid coming from pump 7 into at least one pulsating stream of hydraulic fluid for imparting vibrations to tamping tools 4. As shown in FIG. 1, control 8 is connected to operator's console 9 for operation by an operator at the console, the interconnection between pump 7, control 8 and hydraulic motors 5 being schematically illustrated in FIG. 2.

referring now to FIG. 2, hydraulic fluid delivery conduit 29 is shown connected to the input of hydraulic motor 11 which drives impulse generator 12 for converting the hydraulic fluid flow into a pulsating stream.

Speed control valve 24 is mounted in delivery conduit 29 to meter the hydraulic fluid flow in conduit 29 in correspondence to the desired speed of motor 11 which, in turn, controls the frequency of the impulse generator. Pressure relief valve 34 is mounted in hydraulic fluid return conduit 31'' to return any excess hydraulic fluid to sump 6, as may be required by the setting of speed control valve 24.

The impulse generator has been illustrated herein in a preferred embodiment as a rotary piston pump which is affixed to motor 11 and whose piston means is rotated thereby at a speed set by valve 24. An axially reciprocating piston pump or any equivalent impulse generator may be used instead of the illustrated rotary piston pump.

In addition, rotary piston pump 12 has an input in direct communication with hydraulic fluid sump 6 by means of suction conduit 30. Two diametrically opposite outputs of pump 12 are connected respectively to hydraulic fluid control conduits 13 and 14. The pump may have an adapter defining annular bores interconnecting the pressure outputs of pairs of oppositely positioned pistons to the control conduits.

Control 8 comprises valve assembly or block 15 whose inlets 25, 25 are connected to delivery conduit 36 to deliver hydraulic fluid from impulse generator 12 continuously to the valve assembly. The valve assembly comprises two groups of valves, each group consisting of a pair of check valves 16, 17 and 18, 19. One group of check valves 16, 17 is connected via conduit 33 to cylinder chambers 21 of the two hydraulic motors 5 for reciprocation of the tamping tools of each pair of tools while the other group of check valves 18, 19 is connected via conduit 32 to cylinder chambers 20 of motors 5. The check valves of valve block 15 may be controllable non-return valves, computerized valves and equivalent valve means, each check valve having a control connection for blocking the valve and two operating connections.

The control connections of check valves 16 and 18 are respectively connected by branch line 13' to control conduit 13 and by branch line 14' to control conduit 14 while the two operating connections of these valves are respectively connected to sump 6 by return conduits 31 and 31' and through outlets in valve block 15 to cylinder chambers 21 and 20 by branch lines 33' and 32'. On the other hand, the control connections of check valves 17 and 19 are respectively connected to control conduits 14 and 13 so that the check valves of each group are controlled by the control conduits connected to the outputs of impulse generator 12. The two operating connections of these valves are respectively connected to hydraulic fluid delivery conduit 36 coming from impulse generator 112 and, via branch lines 32' and 33' to cylinder chambers 20 and 21.

The vibration and reciprocation of the tamping tools by the apparatus of the present invention will partly be obvious from the above description of the illustrated embodiment thereof and will be further described hereinafter.

Pump 7, which may be operated by the main drive of machine 1 or any other suitable power source, delivers a hydraulic pressure controlled by valve 24 to motor 11 to impart a desired speed to rotary piston pump 12. Each rotation of the pistons of pump 12 causes the pistons to suck in a certain amount of hydraulic fluid delivered from sump 6 and to deliver this amount of hydraulic fluid into control conduits 13 and 14. By providing two pairs of diametrically opposed pistons, the pistons associated with one of the control conduits, for instance conduit 14, will be in a suction position while the pistons associated with the other control conduit, for instance conduit 13, will be in a pressure position. This, impulse generator 12 will produce alternating impulses or chains of impulses in the hydraulic fluid flow to provide pulsating streams of hydraulic fluid in control conduits 13 and 14, the extent and duration of each impulse or chain of impulses being controlled by the speed of motor 11, i.e. speed control valve 24.

Since the pistons associated with control conduit 13 are in the pressure position, check valves 16 and 19 connected to conduit 13 are blocked while check valves 17, 18 are open since the pistons associated with control conduit 14 are in the suction position and this conduit is connected to valves 17, 18. For the duration of this impulse, the hydraulic fluid continuously delivered by the remaining rotary pistons of pump 12 through delivery conduit 36 to one of the operating connections of check valve 17 is permitted to flow through the now open valve 17 into conduits 33' and 33 to cylinder chambers 21 while the hydraulic fluid thereby displaced in cylinder chambers 20 is permitted to flow through conduits 32, 32' to one of the operating connections of check valve 18 and through the now open valve 18 into return conduit 31'and sump 6. Thus, for the duration of the pressure impulse in control conduit 13, the upper ends of tamping tools 4 are moved apart and the lower jaws of the tamping tools are correspondingly moved together, the tamping tools being pivotally mounted intermediate their ends.

After an angular piston displacement by 180°, the positions are reversed, i.e. valves 17, 18 are blocked and valves 16, 19 are open so that hydraulic fluid is delivered to cylinder chambers 20 and displaced hydraulic fluid from cylinder chambers 21 is returned to the sump through conduits 33, 33' and 31. This causes a reverse movement of the tamping tools.

Unidirectional flow of hydraulic fluid from impulse generator 12 through delivery conduit 36 is assured by oneway valve 38 mounted in conduit 36, pressure relief valve 39 being mounted in return line 31*a* which connects conduit 36 to return conduit 31' to prevent excessive pressure from being built up on conduit 36.

The alternating opening and closing of check valves 17 and 19 enables cylinder chambers 20 or 21 to receive hydraulic fluid from delivery conduit 36 which continuously receives a flow of hydraulic fluid from pump 12 and delivers it to inlets 25, 25 of valve assemby 15. This pulsating stream of hydraulic fluid causes the tamping tools to be vibrated, the frequency as well as the amplitude of the tamping tool vibrations being controlled by the rotary speed of pump 12 which, in turn, is set by speed control valve 24.

Further control of the amplitude of vibrations is available by delivering added amounts of hydraulic fluid from a further constant speed pump 23 delivering hydraulic fluid from sump 6 through additional delivery conduit 26 to inlets 25, 25 of valve assembly 15. Adjustable fluid flow control valve 27 is mounted in conduit 26 to enable the delivery of the added hydraulic fluid to valve block inlets 25, 25 to be controlled in accordance with the desired amplitude of vibrations.

Furthermore, the hydraulic fluid delivery through additional conduit 26 is used for the reciprocation of the tamping tools through their tamping stroke. For this purpose, branch conduits 26' and 26'' are respectively connected to conduits 33 and 32 leading to cylinder chambers 21 and 20, a multi-way valve means 22 being interposed between additional delivery conduit 26 and the branch conduits. Valve means 22 is manually or automatically controlled to deliver hydraulic fluid to a selected pair of cylinder chambers and to permit return of displaced hydraulic fluid from the other pair of cylinder chambers through open check valves 16 or 18.

As shown, one-way valves mounted in additional delivery conduit 26 and branch conduits 26', 26'' permit only unidirectional flow of hydraulic fluid through these conduits from pump 23 to the inlets of valve block 15 and/or cylinder chambers 20, 21, and from conduit 26 to valve means 22. Excessive pressure is relieved through a pressure relief valve forming part of valve means 22 and permitting excess hydraulic fluid to be returned to sump 6 through return conduit 31'.

One-way valves 26*a*, 26*a* mounted in branch conduits 26', 26'' between valve means 22 and motors 5 prevent displacement of the pulsating hydraulic fluid stream into sump 6. The one-way valves in conduit 36, which continuously delivers hydraulic fluid to the inlets of valve block 15, and in additional delivery conduit 26 serve properly to separate the hydraulic fluid deliveries from impulse generator pump 12 and constant speed pump 23.

While tamping tool vibration control 8 has been shown connected directly to motors 5 serving for the reciprocation of the tamping tools in FIG. 2, FIG. 1 indicates that the control may instead be connected to a separate hydraulic motor 10 for imparting vibrations to the tamping tools, i.e. conduits 26', 26'' would lead directly to the cylinder chambers of motors 5 for reciprocation of the tamping tools, while conduits 32 and 33 would lead from valve block 15 to the chambers of hydraulic motor 10. The flow of hydraulic fluid through valve means 22 would be controlled from operator's console 9 to reciprocate the tamping tools. Vibration of the tamping tools would be effected through motor 10, motors 5 associated with one of the tamping tools of each pair being connected with the cylinder of motor 10 while motors 5 associated with the other tamping tools of each pair are respectively connected with opposite ends of the piston rod extending from the cylinder of motor 10 and reciprocating therein under the control of impulse generator 12.

Rather than being mounted on machine frame 1, as shown in FIG. 1, vibration control 8 may advantageously be mounted directly on the vertically adjustable tamping tool carrier of tamping unit 3. This enablves the connections between valve assembly 15 of control 8 and cylinder chambers 20, 21 of motors 5 or of motor 10, if the latter is used for vibration control, to be considerably shortened. This is particularly useful because it is preferred to use pipes for conveying the pulsating streams of hydraulic fluid and this arrangement makes it possible to use short pipes. If connecting hoses are used, the elasticity of the hoses may dampen the pulsations of the hydraulic fluid and thus reduce the efficiency of the vibration system. It is, therefore, preferred to use pipes at least in this portion of the control.

Reciprocation of the tamping tools by operation of valve means 22 and vibration thereof by operation of speed control valve 24 as well as flow metering valve 27 are most simply controlled from operator's console 9 mounted on machine frame 2.

It will be obvious to those skilled in the art that the vibration control of the present invention is not limited to the specifically described and illustrated embodiment. For instance, the illustrated hydraulic impulse generator could be replaced by any suitable impulse generating means for converting a continuous flow of fluid into a pulsating stream, such as an impulse generator actuated by mechanical, electrical or compressed air means, such as a pneumatic motor, with the use of an eccentric shaft for imparting vibrations to the tools. Furthermore, the vibration control may be used on ballast tampers operating with synchronously or asynchronously reciprocable pairs of tamping tools, as well as single tamping tools reciprocable in relation to one side of a tie only. Also, track lining tools or any other track working tools which are desired to be vibrated during operation may be vibrated by the control of this invention. Thus, the metes and bounds of the invention are defined by the appended claims.

What is claimed is:

1. A track working machine comprising a frame mounted for mobility on the track, reciprocable and vibratory tools mounted on the frame for working the track, hydraulic motor means for reciprocating and vibrating the tools, the hydraulic motor means including a hydraulic motor associated with each tool for reciprocating the same and a further hydraulic motor, a hydraulic circuit including a hydraulic fluid sump, a pump for delivering hydrualic fluid from the sump to the hydraulic motor means and return conduit means for returning hydraulic fluid to the sump, and a control in the hydraulic circuit for generating a pulsating stream of the hydraulic fluid and delivering the pulsating stream to the hydraulic motor means whereby the tools are vibrated, the control including an impulse generator for imparting impulses to the hydraulic fluid and thereby generating the pulsating hydraulic fluid stream, and a valve assembly including a plurality of check valves and having inlet means and an outlet means, control conduit means for delivering the pulsating hydraulic fluid stream to the inlet means of the valve assembly, further conduit means for delivering the pulsating hydraulic fluid stream from the outlet means of the valve assembly to respective chambers defined by the hydraulic motor means, the further conduit means being connected to the chambers of the further hydraulic motor and the hydraulic motor associated with each tool being connected to the further hydraulic motor for vibration of the hydraulic motor and the tool associated therewith by the further hydraulic motor, and the hydraulic motor reciproacting the tool, and respective ones of the valves alternately blocking and permitting passage of the pulsating hydraulic fluid stream from the inlet to the outlet means of the valve assembly.

2. In the track working machine of claim 1, the tools being ballast tamping tools.

3. In the track working machine of claim 1, the impulse generator being hydraulically actuated.

4. In the track working machine of claim 3, the hydraulically actuated impulse generator being a pump comprising two opposing pistons in communication with respective pressure outlets, and the conduit means being constituted by two conduits leading from the two pressure outlets to the inlet means of the valve assembly.

5. In the track working machine of claim 4, the impulse generator being a rotary piston pump.

6. In the track working machine of claim 1, the control conduit means comprising two control conduits alternatingly delivering the pulsating hydraulic fluid stream to a first pair of respective inlets of the valve assembly inlet means, delivery conduit means for delivering a continuous flow of hydraulic fluid from the impulse generator to a second pair of respective inlets of the valve assembly inlet means, two pairs of said check valves, one valve of each pair being mounted in a respective one of the control conduits and being alternatingly closed by the hydraulic fluid stream therein, and the other valve of each pair being mounted in the delivery conduit means and being alternatingly opened by the continuously flowing hydraulic fluid, the opened valves being respectively in communication with the return conduit means and the further conduit means.

7. In the track working machine of claim 1, control means for adjusting the frequency of the impulse output of the impulse generator.

8. In the track working machine of claim 1, the impulse generator being a rotary piston pump, and further comprising a motor for driving the rotary pistons of the pump and a speed control for regulating the speed of the motor.

9. In a track working machine comprising a frame mounted for mobility on the track, reciprocable and vibratory tools mounted on the frame for working the track, hydraulic motor means for reciprocating and vibrating the tools, the hydraulic motor means including a hydraulic motor associated with each tool for reciprocating the same, and a hydraulic cirucit including a hydraulic fluid sump, a pump for delivering hydraulic fluid from the sump to the hydraulic motor means and return conduit means for returning hydraulic fluid to the sump: a control in the hydraulic circuit for generating a pulsating stream of the hydraulic fluid and delivering the pulsating stream to the hydraulic motor means whereby the tools are vibrated, the control including an impulse generator for imparting impulses to the hydraulic fluid and thereby generating the pulsating hydraulic fluid stream, and a valve assembly including a plurality of check valves and having inlet means and an outlet means, control conduit means for delivering the pulsating hydraulic fluid stream to the inlet means of the valve assembly, further conduit means for delivering the pulsating hydraulic fluid stream from the outlet means of the valve assembly to respective chambers defined by the hydraulic motor means, respective ones of the valves alternately blocking and permitting passage of the pulsating hydraulic fluid stream from the inlet to the outlet means of the valve assembly, and the hydraulic circuit comprising an additional pump and additional conduit means for delivering hydraulic fluid from the additional pump to the inlet means of the valve assembly, and a fluid flow control valve in the additional conduit means.

10. A track working machine comprising a frame mounted for mobility on the track, reciprocable and vibratory tools mounted on the frame for working the track, hydraulic motor means for reciprocating and vibrating the tools, the hydraulic motor means consisting of hydraulic motors associated with respective ones of the tools for reciprocating the same, a hydraulic circuit including a hydraulic sump, a pump for delivering hydraulic fluid from the sump to the hydraulic motors and return conduit means for returning hydraulic fluid to the sump, an additional pump and additional conduit means for delivering hydraulic fluid from the additional pump to the chambers of the hydraulic motors for reciprocating the tools, and a control valve in the additional conduit means, and a control in the hydraulic circuit for generating a pulsating stream of the hydraulic fluid and delivering the pulsating stream to the hydraulic motor means whereby the tools are vibrated, the control including an impulse generator for imparting impulses to the hydraulic fluid and thereby generating the pulsating hydraulic fluid stream, and a valve assembly including a plurality of check valves and having inlet means and an outlet means, control conduit means for delivering the pulsating hydraulic fluid stream to the inlet means of the valve assembly, further conduit means for delivering the pulsating hydraulic fluid stream from the outlet means of the valve assembly to respective chambers defined by the hydraulic motor means, the further conduit means being connected to the chambers of the hydraulic motors for reciprocating and vibrating the tools, and respective ones of the valves alternately blocking and permitting passage of the pulsating hydraulic fluid stream from the inlet to the outlet means of the valve assembly.

* * * * *